US011598191B2

(12) United States Patent
Fripp et al.

(10) Patent No.: US 11,598,191 B2
(45) Date of Patent: Mar. 7, 2023

(54) INDEPENDENT CONTROL FOR SIMULTANEOUS FRACTURING OF MULTIPLE WELLBORES

(71) Applicant: Halliburton Energy Services, Inc., Houston, TX (US)

(72) Inventors: Michael Linley Fripp, Carrollton, TX (US); Chad A. Fisher, Duncan, OK (US); Mehdi Mazrooee, Houston, TX (US); Ronald Glen Dusterhoft, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/382,533

(22) Filed: Jul. 22, 2021

(65) Prior Publication Data

US 2023/0024323 A1 Jan. 26, 2023

(51) Int. Cl.

| | |
|---|---|
| ***E21B 43/26*** | (2006.01) |
| ***E21B 43/267*** | (2006.01) |
| ***E21B 43/14*** | (2006.01) |
| ***F04B 49/00*** | (2006.01) |
| ***E21B 21/06*** | (2006.01) |

(52) U.S. Cl.

CPC ..... *E21B 43/2607* (2020.05); *E21B 43/14* (2013.01); *E21B 43/26* (2013.01); *E21B 43/267* (2013.01); *F04B 49/00* (2013.01); *E21B 21/062* (2013.01)

(58) Field of Classification Search

CPC ..... E21B 43/2607; E21B 43/14; E21B 43/26; E21B 43/267; E21B 21/062; F04B 49/00

See application file for complete search history.

(56) References Cited

U.S. PATENT DOCUMENTS

| | | | | |
|---|---|---|---|---|
| 10,294,768 | B2 | 5/2019 | Mazrooee et al. | |
| 11,352,552 | B1 * | 6/2022 | Fisher | C09K 8/882 |
| 2007/0277982 | A1 * | 12/2007 | Shampine | E21B 43/16 166/308.1 |

(Continued)

FOREIGN PATENT DOCUMENTS

| | | | | |
|---|---|---|---|---|
| CA | 2773019 C | * | 8/2014 | C09K 8/62 |
| WO | WO-2015021523 A1 | * | 2/2015 | E21B 43/267 |
| WO | 2020/027796 A1 | | 2/2020 | |

*Primary Examiner* — James G Sayre

(74) *Attorney, Agent, or Firm* — Conley Rose, P.C.; Rodney B. Carroll

(57) ABSTRACT

A system and method for independent control of simultaneous fracturing for multiple wellbores is disclosed. In certain embodiments, a first clean pumping unit and a first dirty pumping unit are fluidically coupled to a first wellbore, wherein the first clean pumping unit pumps a first fluid to the first wellbore and the second clean pumping unit pumps a second fluid to the first wellbore. In certain embodiments, a second clean pumping unit and a second dirty pumping unit are fluidically coupled to a second wellbore, wherein the second clean pumping unit pumps the first fluid to the second wellbore and the second dirty pumping unit pumps. In certain embodiments, a controller controls a pumping rate of at least one of the first clean pumping unit and the first dirty pumping unit based on a desired parameter of a combined fluid pumped to the first wellbore.

20 Claims, 5 Drawing Sheets

(56) References Cited

U.S. PATENT DOCUMENTS

| | | | | |
|---|---|---|---|---|
| 2014/0352968 | A1* | 12/2014 | Pitcher | E21B 43/26<br>166/308.1 |
| 2016/0312595 | A1* | 10/2016 | Surjaatmadja | C09K 8/665 |
| 2020/0056466 | A1 | 2/2020 | Mazrooee et al. | |
| 2021/0010363 | A1* | 1/2021 | Kriebel | E21B 43/2607 |
| 2021/0310346 | A1* | 10/2021 | Bull | E21B 43/2607 |

* cited by examiner

INDEPENDENT CONTROL FOR SIMULTANEOUS FRACTURING OF MULTIPLE WELLBORES

TECHNICAL FIELD

The present disclosure relates to systems and methods for simultaneous fracturing of multiple wellbores.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. In the production of hydrocarbons from a subterranean formation, the subterranean formation should be sufficiently conductive to permit the flow of desirable fluids to a well bore penetrating the formation. One type of treatment used in the art to increase the conductivity of a subterranean formation is hydraulic fracturing. Hydraulic fracturing operations generally involve pumping a treatment fluid (e.g., a fracturing fluid or a "pad fluid") into a wellbore that penetrates a subterranean formation at or above a sufficient hydraulic pressure to create or enhance one or more pathways, or "fractures," in the subterranean formation. These fractures generally increase the permeability and/or conductivity of that portion of the formation. The fluid may comprise particulates, often referred to as "proppant," that are deposited in the resultant fractures. Proppant may help prevent the fractures from fully closing upon the release of the hydraulic pressure, forming conductive channels through which fluids may flow to a wellbore.

In certain instances, it may be desirable to perform hydraulic fracturing on multiple wellbores at the same time. Currently, some present systems only allow for fracturing a single wellbore at a time. Other systems that allow for simultaneous fracturing on two or more wells typically require using the same proppant delivery schedule for each well. In those systems, control of pumping schedules to the multiple wellbores may be controlled by way of upstream flow control from a common blender system. For example, a common blender system may mix fluid and slurry upstream of one or more fracturing pumps and deliver the same flow and concentration of the mixed fluid and slurry to the pumps for injection into multiple wellbores. Such a system does not allow for flexibility based on the needs of a given individual wellbore. Additionally, such a system may cause wear and tear on equipment due to dirty fluid flowing through components including the pumps, piping, valves, etc. Limiting the flow of dirty fluid through a subset of pumps may extend the life of other pumps and associated components.

BRIEF DESCRIPTION OF THE DRAWINGS

These drawings illustrate certain aspects of some of the embodiments of the present disclosure and should not be used to limit or define the claims.

Figure 1:
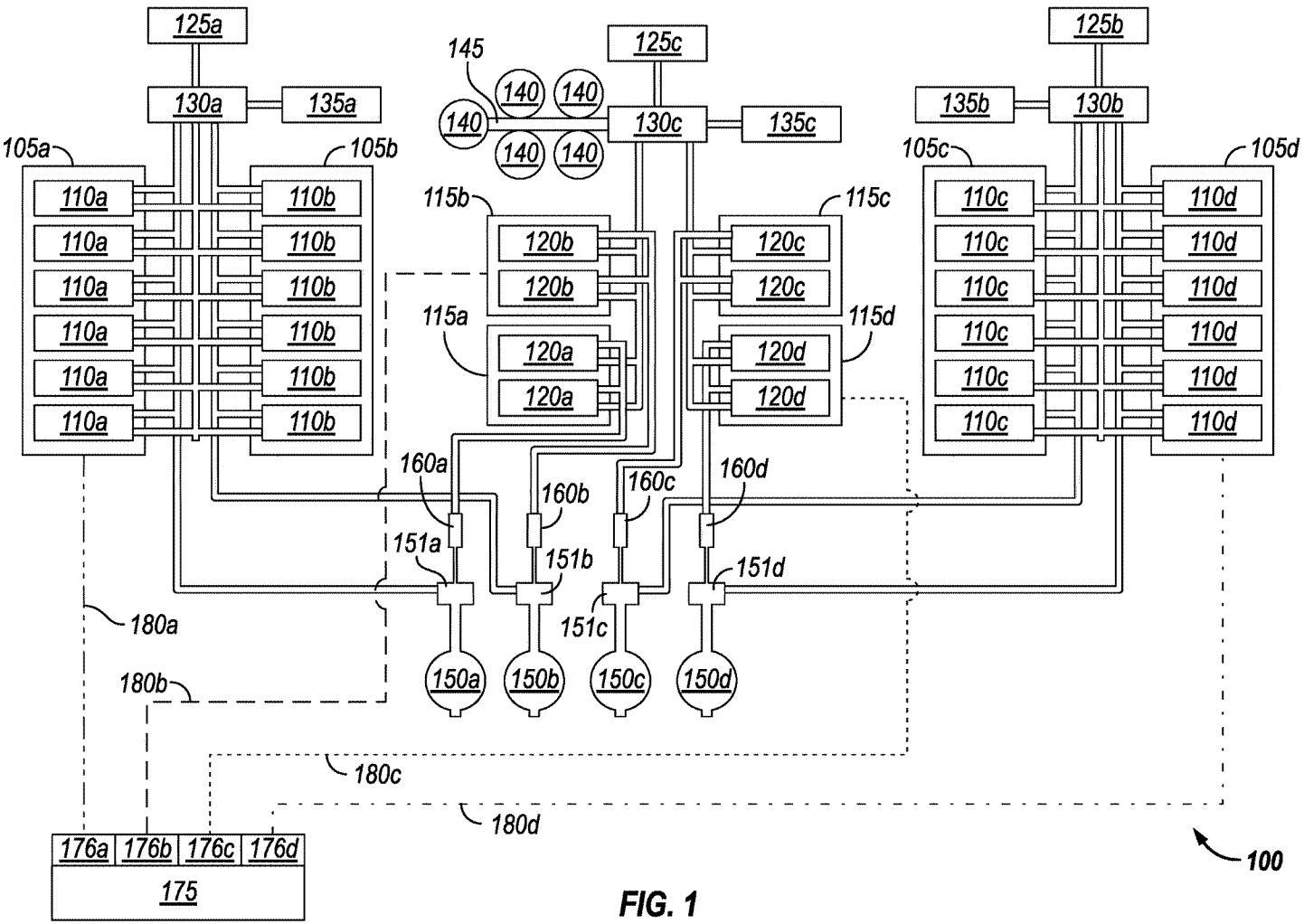
FIG. 1 is a schematic diagram illustrating an example of a fracturing system for multiple wellbores, in accordance with certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection.

Throughout this disclosure, a reference numeral followed by an alphabetical character refers to a specific instance of an element and the reference numeral alone refers to the element generically or collectively. For example, a widget "1a" refers to an instance of a widget class, which may be referred to collectively as widgets "1" and any one of which may be referred to generically as widget "1". In the figures and the description, like numerals are intended to represent like elements. A numeral followed by the alphabetical characters "N" refers to any number of widgets.

Certain embodiments of the present disclosure are directed to systems and methods for simultaneously fracturing multiple wellbores with independent control of the fracturing fluid provided to each wellbore. In certain instances, it may be desirable to have independent control of the one or more pumps, for example, both clean pumps and dirty pumps, while maintaining a constant rate of proppant-laden fluid from the blender. Adjusting individual pumps on the downstream side of the blender may provide more flexibility in controlling the amount and pressure of fracturing fluid pumped into a given wellbore. Individual control of pumps may allow control of the direction of the hydraulic fracture may be achieved. One of the potential tradeoffs in fracturing efficiency is that the formation may build substantial residual stress as additional zones are fractured. With greater stimulation efficiency, the injected fluid has less time to dissipate into the formation. As a result, the injected fluid remains in the fracture zone and increases the stress in the formation. Controlled adjustment of the fluid rates and proppant concentration can allow for filling the fracture before the residual formation stress limits local fracture growth. Furthermore, controlling the hydraulic stress from multiple wellbores may allow for steering, controlling, and/or directing the fracture plane, for example, from the combined stress state of two or more wells.

As used herein, a "clean" pump may refer to a pump that is used for pumping fluid that substantially comprises water. Similarly, "clean" fluid may refer to fluid that contains a minimal amount or no proppant or sand. In certain instances, "clean" fluid may comprise additives such as salts, friction reducers, corrosion inhibitor, gelling agents, acidifying agents, chemical additives, or any other types of additives. "Dirty" fluid may refer to fluid that comprises sand or proppant, or fluid that is sand-laden. A "dirty" pump may refer to a pump that is used for pumping fluid that comprises sand or proppant. In certain instances, the dirty pumps may pump fluids with a proppant concentration of 5% to 60%. As used herein, "dirty" fluid may also be referred to as "slurry". In certain instances, "dirty" fluid may also comprise one or more additives, for example, the additives listed above with respect to the "clean" fluid.

Turning now to the drawings, FIG. 1 shows an exemplary wellsite 100, in accordance with certain embodiments of the present disclosure. As shown in FIG. 1, wellsite 100 may comprise several types of equipment, including one or more pumping units 105 and/or 115, where each of the pumping units 105 or 115 each comprise one or more pumps, for example pumps 110 and/or 120. In certain embodiments, pumping units 105 may be clean pumping units 105 and pumping units 115 may be dirty pumping units 115. Clean pumping units 105 may each comprise one or more clean pumps 110. Dirty pumping units 115 may each comprise one or more dirty pumps 120. For example, as shown in FIG. 1, each clean pumping unit 105 may comprise six clean pumps 110. Similarly, each dirty pumping unit 115 may comprise two dirty pumps 120. However, as would be understood by one of ordinary skill in the art, any other number of pumps 110 or 120 may be appropriate in keeping with the aspects of the present disclosure.

Wellsite 100 may further comprise one or more fluid supply units 125, additive supply units 135, and blender units 130. As would be understood by one of ordinary skill in the art, any number of each of these components, e.g., pumping units 105 and 115, pumps 110 and 120, fluid supply units 125, additive supply units 135, and blender units 130 may be varied or adjusted in accordance with the fracturing job requirements of a particular wellsite 100. The number of components shown in FIG. 1 should not be read to limit or otherwise specify the number of appropriate components at a given wellsite 100. Wellsite 100 may further comprise one or more wellbores 150, for example, wellbores 150*a*, 150*b*, 150*c*, and 150*d*. While FIG. 1 depicts four wellbores 150, the number of wellbores 150 may similarly be varied to meet the fracturing job requirements of a particular wellsite 100.

In certain embodiments, as shown in FIG. 1, elements 130 may be blender units fluidically coupled to one or more fluid supply units 125. For example, blender unit 130*a* may be fluidically coupled to fluid storage unit 125*a*, blender unit 130*b* may be fluidically coupled to fluid storage unit 125*b*, and blender unit 130*c* may be fluidically coupled to fluid storage unit 125*c*. One or more fluid storage units 125 may be positioned at a wellsite 100, for example, fluid storage units 125*a*, 125*b*, and 125*c* as shown in FIG. 1. In certain embodiments, fluid storage units 125 may supply water, brine, produced water, treatment water, or other types of fluid to the blender units 130.

In certain embodiments, one or more blender units 130 may be fluidically coupled to one or more additive supply units 135. For example, blender unit 130*a* may be fluidically coupled to additive supply unit 135*a* and blender unit 130*b* may be fluidically coupled to additive storage unit 135*b*. In certain embodiments, blender units 130*a* and 130*b* may be additive blender units or clean fluid blender units 130*a* and 130*b* that mix fluids with additives. In certain embodiments, no additives may be added to the fluid in fluid blenders 130*a* and 130*b*. In these embodiments, additive storage units 135*a* and 135*b* may not be present as shown in FIG. 1. For example, in certain embodiments, the additives may be supplied only from additive storage unit 135*c*. In certain embodiments, additive storage units 135 may supply chemical additives, for example, high viscosity friction reducers (HVFR), surfactants, breakers, modifiers, stabilizers, cross-linkers, gel-lining agents, PH buffers, or any other types of additives.

In certain embodiments, for example, where no additives are needed, elements 130 may be transfer units for transferring fluid from one location to another. For example, one or more elements 130 may be a centrifugal pump, boost pump, or any other type of positive displacement pump. For example, in certain embodiments, elements 130*a* and 130*b* may each be a boost pump used for transferring or boosting the low-pressure fluid from the fluid storage units 125*a* and 125*b* to the high-pressure pumping units 105. In certain embodiments, a blending unit may still be used as a transfer unit despite no additives being added to the clean fluid.

In certain embodiments, one or more blender units 130 may be fluidically coupled to one or more proppant storage units 140. For example, blender unit 130*c* may be fluidically coupled to one or more proppant storage units 140 as shown in FIG. 1. In certain embodiments, blender unit 130*c* may be a proppant blender unit or dirty fluid blender unit 130*c* that mixes fluid with proppant. The resulting fluid may be referred to as fracturing fluid or "slurry." In certain embodiments, blender unit 130*c* may also mix additives from additive storage unit 135*c*. In certain embodiments, proppant storage units 140 may supply one or more types of proppant, including sand, salt, dirt, grain, fertilizer, ceramic spheroids, metal particles, aggregate, or any other type of particulate or solid additive that may be used to hold or prop open fractures created by hydraulic fracturing. "Proppant" as used herein may refer to naturally occurring particulate materials and/or particles coated with a material, such as resin, and manmade products, such as ceramics and metals. In certain embodiments, a proppant storage unit 140 may be a silo, box container, tank, hopper, or any other type of suitable container for storing proppant. In certain embodiments, blender units 130*a*, 130*b*, and 130*c* may comprise or otherwise be fluidically coupled to separate pre-gel blending unit or hydration unit (not shown). In certain embodiments, a conveyor 145 may be coupled to the one or more proppant storage containers 140 and a blending unit 130, for example, blending unit 130*c*. Conveyor 145 may be used to transport proppant or sand from the one or more proppant storage containers 140 to the blending unit 130*c* to be mixed with the fluid and/or additives in the blending unit 130*c*.

In certain embodiments, one or more blender units 130 may be fluidically coupled to one or more clean pumping units 105 and/or one or more dirty pumping units 115. As shown in FIG. 1, in certain embodiments, each clean pumping unit 105 may comprise one or more clean pumps 110. For example, clean pumping unit 105*a* may comprise one or more clean pumps 110*a*, clean pumping unit 105*b* may comprise one or more clean pumps 110*b*, clean pumping unit 105*c* may comprise one or more clean pumps 110*c*, and clean pumping unit 105*d* may comprise one or more clean pumps 110*d*. Similarly, as shown in FIG. 1, in certain embodiments, each dirty pumping unit 115 may comprise one or more dirty pumps 120. For example, in certain embodiments, dirty pumping unit 115*a* may comprise one or more dirty pumps 120*a*, dirty pumping unit 115*b* may comprise one or more dirty pumps 120*b*, dirty pumping unit 115*c* may comprise one or more dirty pumps 120*c*, and dirty pumping unit 115*d* may comprise one or more dirty pumps 120*d*. As would be understood by one of ordinary skill in the art, the number of pumps 110 or 120 comprising each pumping unit 105 or 110 may be varied based on one or more factors, for example, the fracturing job requirements of the wellsite or the requirements of a given well 130.

In certain embodiments, blender unit 130*a* may be fluidically coupled to clean pumping units 105*a* and 105*b*, blender unit 130*b* may be fluidically coupled to clean pumping units 105*c* and 105*d*, and blender 130*c* may be fluidically coupled to dirty pumping units 115*a*, 115*b*, 115*c*, and 115*d*. In certain embodiments, fluid output from one or more blenders 130 may be supplied to one or more pumping units 105 and/or 115. For example, fluid mixed with additives at blender 130*a* may be provided to clean pumping units 105*a* and 105*b*, and fluid mixed with additives at blender 130*b* may be provided to clean pumping units 105*c* and 105*d*. Furthermore, fluid mixed with proppant at blender 130*c* may be provided to dirty pumping units 115*a*, 115*b*, 115*c*, and 115*d*.

In certain embodiments, fluid from one or more clean pumps 110 and/or dirty pumps 120 may be provided to one or more wells 150. For example, fluid from one or more clean pumps 110*a* may be provided to wellbore 150*a*, fluid from one or more clean pumps 110*b* may be provided to wellbore 150*b*, fluid from one or more clean pumps 110*c* may be provided to wellbore 150*c*, and fluid from one or more clean pumps 130*d* may be provided to wellbore 150*d*. Similarly, for example, fluid from one or more dirty pumps 120*a* may be provided to wellbore 150*a*, fluid from one or more dirty pumps 120*b* may be provided to wellbore 150*b*, fluid from one or more dirty pumps 120*c* may be provided to wellbore 150*c*, and fluid from one or more dirty pumps 120*d* may be provided to wellbore 130*d*. In certain embodiments, more clean pumps 110 may be needed than dirty pumps 120 for a given well, as shown in FIG. 1. While six clean pumps 110 and two dirty pumps 120 per wellbore 150 are shown in FIG. 1, other quantities/ratios of clean pumps 110 to dirty pumps 120 may be appropriate for a given wellbore 150. For example, in certain embodiments, two, four, eight, ten, or twenty clean pumps 110 may be used for a given wellbore 150, and one, three, five, or ten dirty pumps 120 may be used for the same wellbore 150.

A wellsite 100 may further comprise a control unit 175. In certain embodiments, control unit 175 may be positioned remote from the equipment described above, for example, the one or more clean pumping units 105, one or more dirty pumping units 115, one or more fluid storage units 125, one or more blender units 130, one or more additive storage units 135, or one or more proppant storage units 140. In other embodiments, control unit 175 may be positioned at or near the equipment, for example, near the one or more clean pumping units 105, one or more dirty pumping units 115, one or more fluid storage units 125, one or more blender units 130, one or more additive storage units 135, or one or more proppant storage units 140. In certain embodiments. In certain embodiments, control unit 175 may comprise one or more sub-controllers 176, for example, sub-controllers 176*a*, 176*b*, 176*c*, 176*d*.

In certain embodiments, control unit 175 may control the rate of pumping for the one or more pumps 110 and/or 120. For example, in certain embodiments, one or more pumping units 105 and/or 115 may comprise a motor (not shown) for driving the one or more pumps 110 and/or 120. In certain embodiments, the motor may be a variable frequency drive motor or a drive and transmission gearbox. In certain embodiments, control unit 175 may be communicatively coupled to one or more pumping units 105 and/or 115, either wirelessly or via wired control line. For example, in certain embodiments, sub-controller 176*a* may be communicatively coupled to clean pumping unit 105*a*, sub-controller 176*b* may be communicatively coupled to dirty pumping unit 115*a*, sub-controller 176*c* may be communicatively coupled to dirty pumping unit 115*d*, and sub-controller 176*d* may be communicatively coupled to clean pumping unit 105*d*. In certain embodiments, the rate of flow from one or more pumping units 105 and/or 115 may be set or adjusted such that the rate or concentration of clean fluid and/or dirty fluid to the one or more wellbores 150 is regulated or controlled. In certain embodiments, when lower proppant concentrations are needed, e.g., at the beginning of a job, fewer dirty pumps 115 may be pumping slurry. For example, in certain embodiments, sub-controller 176*a* may send a signal to all six clean pumps 110*a* to begin pumping clean fluid to wellbore 150*a*. Concurrently, sub-controller 176*b* may send a signal to only one dirty pump 120*a* to begin pumping slurry to wellbore 150*a*. As more proppant is needed, sub-controller 176*a* may adjust the number of clean pumps 110*a* in operation, and sub-controller 176*b* may adjust the number of dirty pumps 120*b* operation. For example, to increase the proppant concentration, sub-controller 176*a* may send a signal to shut off two clean pumps 110 and reduce the number of clean pumps 110*a* in operation to four. At the same or a later time, sub-controller 176*b* may send a signal to bring online a second dirty pump 120*a* to increase the number of dirty pumps 120*a* in operation to two. Thus, the increase in the ratio of dirty pumps 120 to clean pumps 110 may result in a corresponding increase in proppant concentration.

In certain embodiments, a desired combined rate of fluid flow may be provided to each wellbore 150. For example, in certain embodiments, a desired combined fluid flow rate may be, for example, 60 barrels per minute (bpm). In certain embodiments, a desired combined rate of fluid flow may comprise a clean fluid flow rate and a dirty fluid flow rate. In order to achieve the desired combined fluid flow rate, a dirty fluid flow rate may be approximately 10 bpm to 20 bpm, and a clean fluid flow rate may be approximately 40 bpm to 50 bpm. In certain embodiments, the ratio of clean fluid to dirty fluid may be selected to keep a desired proppant concentration constant. For example, in certain embodiments, the desired proppant concentration may be 8 pounds per gallon (ppg). The proppant concentration of the dirty fluid may be greater than 8 ppg and the proppant concentration of the clean fluid may be lower than 8 ppg, for example, approximately 0 ppg. Thus, the dirty fluid and clean fluid may be mixed together to achieve a desired proppant concentration. As would be understood by one of ordinary skill in the art, the above flow rates and desired proppant concentration may be varied based on one or more factors, for example, the needs of a particular well 150. For example, in certain embodiments, a higher or lower proppant concentration may be required, for example, 2 ppg, 4 ppg, 6 ppg, 10, ppg, 12 ppg, or 20 ppg. The desired proppant concentration may be determined based on one or more factors, for example, the rate of fluid acceptance from the formation, the formation stress created by previous fractures, the previous amount of proppant that has been pumped for a given stage, the fluid resistance of the formation, or the release of diverting agents.

Figure 2:
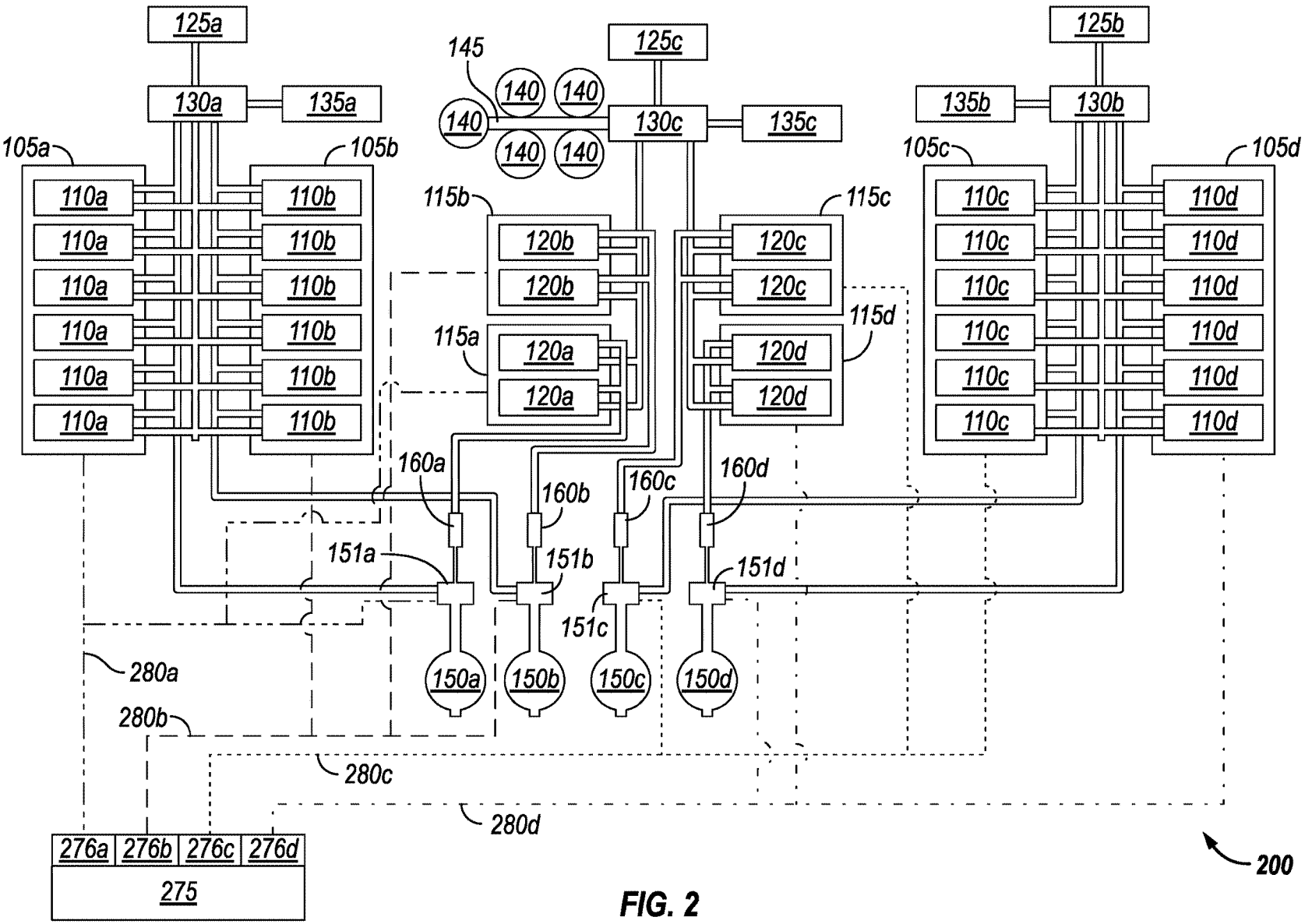
FIG. 2 is a schematic diagram illustrating an example of a fracturing system for multiple wellbores, in accordance with certain embodiments of the present disclosure.

FIG. 2 shows another embodiment of a wellsite 200, in accordance with certain aspects of the present disclosure. Wellsite 200 may be configured similarly to wellsite 100. However, as shown in FIG. 2, control of the one or more pumping units 105 and/or 115 may differ in certain respects. Similar to control unit 175 in FIG. 1, control unit 275 of FIG. 2 may comprise sub-controllers 276*a*, 276*b*, 276*c*, and 276*d*. In certain embodiments, sub-controller 276*a* may be communicatively coupled to both clean pumping unit 105*a* and dirty pumping unit 115*a*. Thus, in certain embodiments, sub-controller 276*a* may control the pumping rate of the clean pumping unit 105*a* and the dirty pumping unit 115*a* or the number of the one or more clean pumps 110*a* and the one or more dirty pumps 120*a* in operation. Sub-controller 276*a* may thus have independent control over the combined fluid flow rate and proppant concentration to wellbore 150*a*. Similarly, in certain embodiments, sub-controller 276*d* may be communicatively coupled to both clean pumping unit 105*d* and dirty pumping unit 115*d*. In certain embodiments, sub-controller 276*d* may control the pumping rate of the clean pumping unit 105*d* and the dirty pumping unit 115*d* or the number of the one or more clean pumps 110*d* and the one or more dirty pumps 120*d* in operation. Sub-controller 276*d* may thus have independent control over the combined fluid flow rate and proppant concentration to wellbore 150*d*. Thus, control of fluid flow rates to wellbores 150*a* and 150*d* may be achieved using only two sub-controllers 276, compared to the four sub-controllers 176 required to control wellbores 150*a* and 150*d* as discussed regarding FIG. 1.

By reducing the number of sub-controllers 276 required to control the fluid flow rate to a given wellbore 150, a greater number of wellbores 150 may be fractured simultaneously. For example, sub-controller 276*b* may be communicatively coupled to both clean pumping unit 105*b* and dirty pumping unit 115*b*. In certain embodiments, sub-controller 276*b* may control the pumping rate of clean pumping unit 105*b* and dirty pumping unit 115*b* or the number of the one or more clean pumps 110*b* and the one or more dirty pumps 120*b* in operation. Sub-controller 276*b* may thus have independent control over the combined fluid flow rate and proppant concentration to wellbore 150*b*. Similarly, in certain embodiments, sub-controller 276*c* may be communicatively coupled to both clean pumping unit 105*c* and dirty pumping unit 115*c*. In certain embodiments, sub-controller 276*c* may control the pumping rate of clean pumping unit 105*c* and dirty pumping unit 115*c* or the one or more clean pumps 110*c* and the one or more dirty pumps 120*c* in operation. Sub-controller 276*c* may thus have independent control over the combined fluid flow rate and proppant concentration to wellbore 150*c*.

Figure 3:
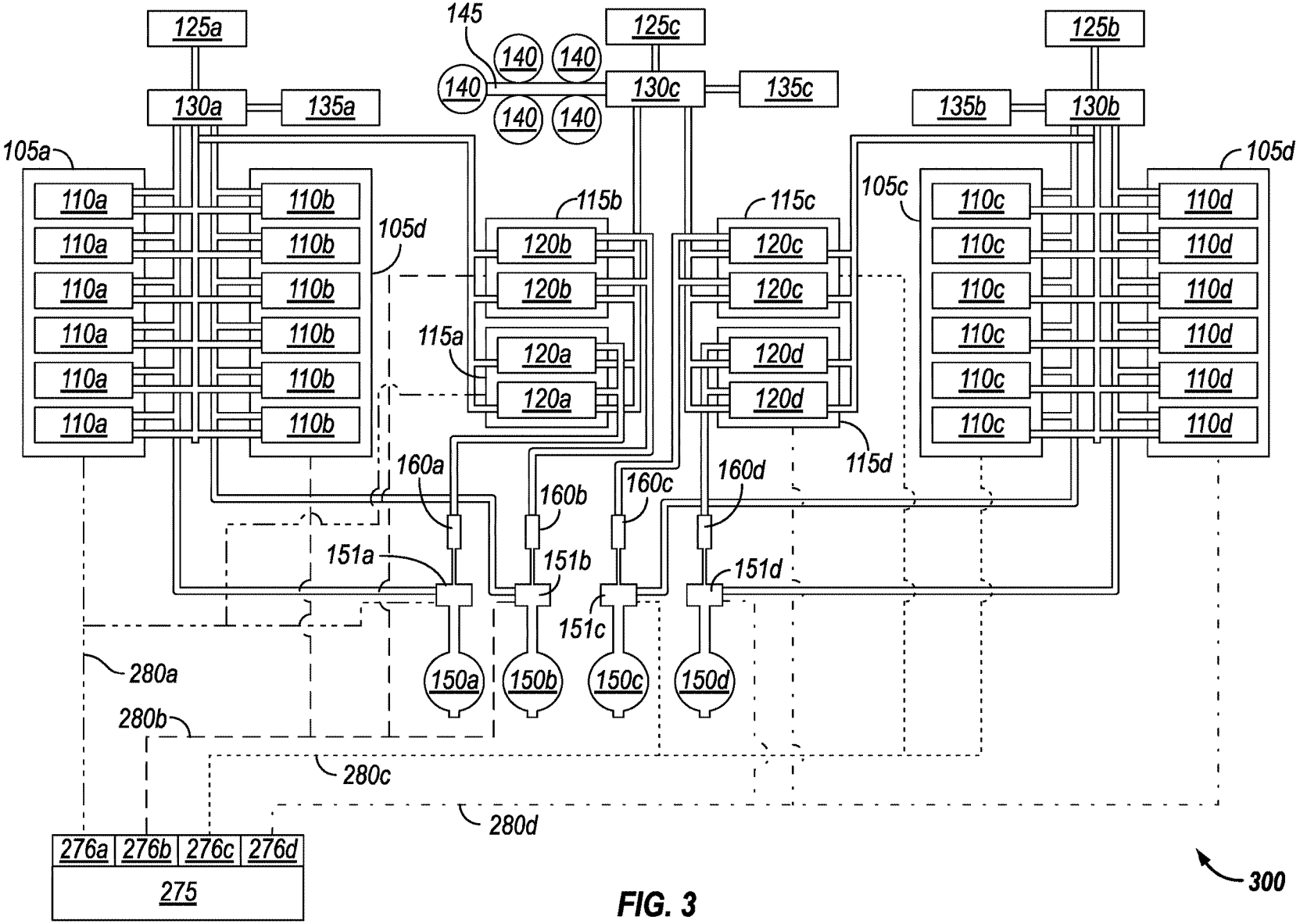
FIG. 3 is a schematic diagram illustrating an example of a fracturing system for multiple wellbores, in accordance with certain embodiments of the present disclosure.

FIG. 3 shows another embodiment of a wellsite 300 for independent control of multiple wells 130, in accordance with certain aspects of the present disclosure. Wellsite 300 may be configured similarly to wellsite 100 and wellsite 200. However, as shown in FIG. 3, wellsite 300 may differ in certain respects. For example, in certain embodiments, one or more dirty pumps 120 may be fluidically coupled to clean fluid blenders 130*a* and 130*c*. As discussed in more detail below with respect to FIGS. 4A-4C, in certain embodiments, it may be beneficial for the one or more dirty pumps 120 to be fluidically coupled to both the slurry blender 130*c* and one or more clean fluid blenders 130*a* or 130*b*. For example, in certain embodiments, it may be desirable to shut off one or more dirty pumps 120. However, leaving residual proppant slurry in a dirty pump 120 is not desirable as proppant can settle out of the fluid and cause startup problems or damage to the dirty pump 120. In order to mitigate these risks, each dirty pump 120 that is shut off may be flushed with clean fluid, for example, fluid from one or more clean fluid blenders 130. In these instances, fluid may be supplied from one or more clean fluid blenders 130, for example, additive blenders 130*a* and/or 130*b*, to a given dirty pump 120.

In certain embodiments, the flushing of the one or more dirty pumps 120 may be automated. For example, when the pump rate of a given dirty pump 120 is reduced to a rate where the dirty pump 120 is unable to pump slurry, one or more valves (shown in FIG. 4) may be used to control the flow of fluid to the dirty pump 120. Automated control of fluid to the one or more dirty pumps is described in more detail with respect to FIGS. 4A-4C.

Figure 4A:
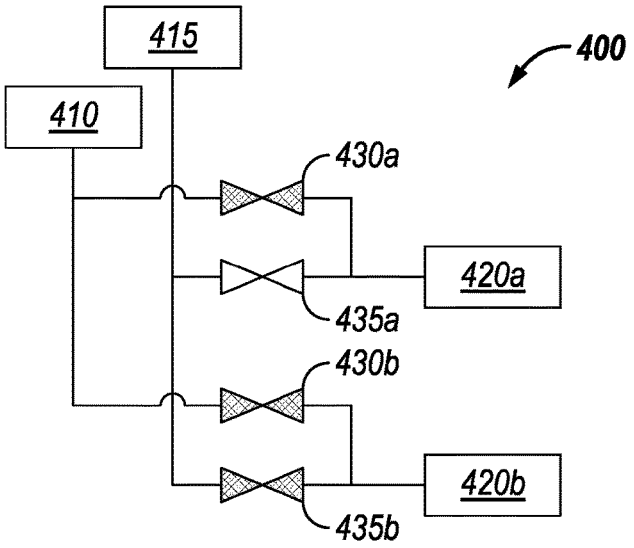
FIGS. 4A-4C are schematic diagrams illustrating an example of a valve control system for one or more pumps, in accordance with certain embodiments of the present disclosure.
Figure 4B:
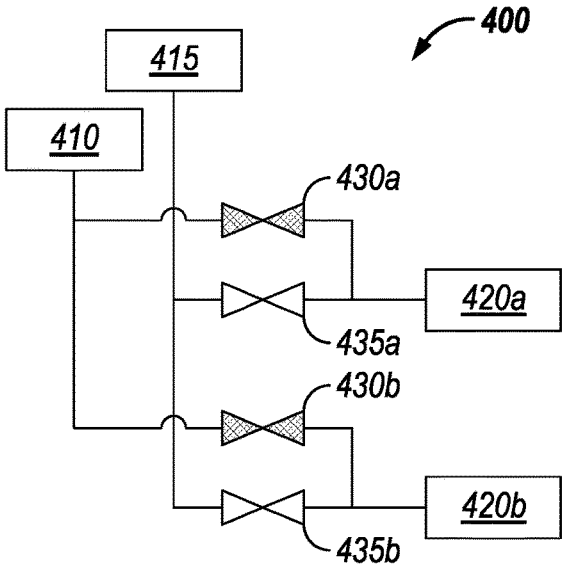
Figure 4C:
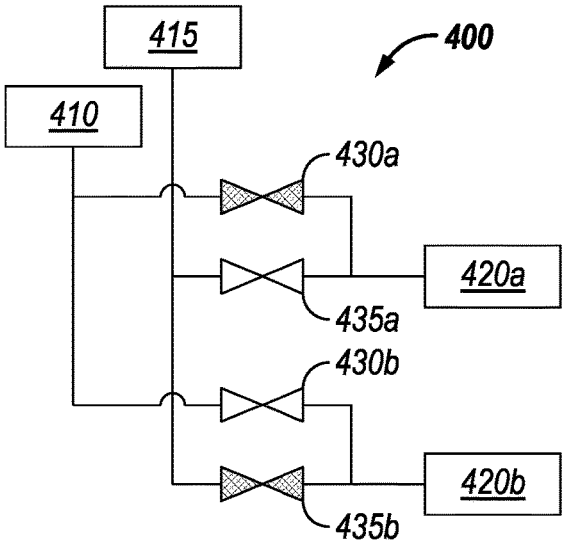

FIGS. 4A-4C depict an expanded view of one or more pumps 420, for example pumps 420*a* and 420*b*. In certain embodiments, as depicted in FIGS. 4A-4C, pumps 420*a* and 420*b* may represent any two dirty pumps 120 in FIGS. 1-3. For example, in certain embodiments, pumps 420*a* and 420*b* may correspond to the two dirty pumps 120*a*, 120*b*, 120*c*, or 120*d* shown in FIGS. 1-3. In certain embodiments, pumps 420*a* and 420*b* may represent all dirty pumps 120 or any combination of two dirty pumps 120*a*, 120*b*, 120*c*, and 120*d*. In certain embodiments, pumps 420*a* and 420*b* may represent any two or more clean pumps 110. In FIGS. 4A-4C, blender units 410 and 415 may represent any one or more of blender units 130 in FIGS. 1-3. For example, in FIGS. 4A-4A, blender 410 may correspond to a clean fluid blender unit 130*a* or 130*b*, and blender 415 may correspond to a slurry blender unit 130*c*. As described above, in certain embodiments, blender 410 may correspond to a boost pump 130*a* or 130*b* when no additives are needed.

As shown in FIGS. 4A-4C, pumps 420*a* and 420*b* may each be fluidically coupled to a clean fluid blender 410 and a slurry blender 415. In certain embodiments, one or more valves 430 and/or 435 may be positioned between pumps 420*a* and 420*b* and clean fluid blender 410 and slurry blender 415, respectively. For example, in certain embodiments, valve 430*a* may be positioned between clean fluid blender 410 and pump 420*a*, valve 430*b* may be positioned between clean fluid blender 410 and pump 420*b*, valve 435*a* may be positioned between slurry blender 415 and pump 420*a*, and valve 435*b* may be positioned between slurry blender 415 and pump 420*b*. Each of the one or more valves 430 and 435 may comprise an open position and a closed position, such that in an open position fluid is allowed to flow through the valves 430 and 435 and in a closed position, fluid is substantially blocked or restricted from flowing through the valves 430 and 435.

FIG. 4A depicts an exemplary valve control system 400 in accordance with certain embodiments of the present disclosure, for example, when lower amounts of slurry for a fracturing job is needed. In certain embodiments, for example, at the beginning of a fracturing job, a desired proppant concentration may be lower than an eventual desired proppant concentration at later stages of the job, as discussed above. For example, in certain embodiments, when a fracturing job begins, the desired proppant concentration may be approximately 2 ppg, whereas in later stages, the desired proppant concentration may be approximately 8 ppg. In certain embodiments, the proppant concentration may begin at 0 ppg while a fracture is initially opened. Then the proppant concentration may be increased gradually to reach a desired proppant concentration level, for example, 8 ppg. In certain embodiments, the proppant concentration may be oscillated between 0 ppg and a target concentration to create pillars of proppant within a formation. Thus, at the beginning of a job, as shown in FIG. 4A, valve 430*a* may be closed and valve 435*a* may be open such that slurry from slurry blender 415 flows to pump 420*a*, and no fluid from clean fluid blender 410 flows to pump 420*a*. Valve 430*b* and 435*b* may both be closed such that no fluid, clean or dirty, flows to pump 420*b*.

FIG. 4B depicts an exemplary valve control system 400 in accordance with certain embodiments of the present disclosure, for example, when the need for slurry increases in comparison to the configuration of FIG. 4A. As more slurry is needed to support a fracturing job, valves 435*a* and 435*b* may both be open such that slurry flows from slurry blender 415 to both pumps 420*a* and 420*b*, and valves 430*a* and 430*b* may both be closed such that no clean fluid flows from clean fluid blender 410 to pumps 420*a* and 420*b*. Thus, the proppant concentration pumped by pumps 420*a* and 420*b* may increase in comparison to the configuration in FIG. 4A, until the desired proppant concentration is reached, e.g., 8 ppg. The slurry from pumps 420*a* and 420*b* may be pumped to the one or more wellbores 150 as discussed above with respect to FIGS. 1-3. The desired proppant concentration could be further adjusted by controlling the number of clean pumps 110 (shown in FIGS. 1-3) pumping clean fluid to the one or more wellbores 150.

FIG. 4C depicts an exemplary valve control system 400 in accordance with certain embodiments of the present disclosure, for example, when the need for slurry decreases in comparison to the configuration of FIG. 4B. If the amount of slurry needed for a job drops to a level that could supported by a single pump 420, valve 430*b* may be opened and valve 435*b* may be closed such that clean fluid is delivered from clean fluid blender 410 to pump 420*b* and no slurry from slurry blender 415 is delivered to pump 420*b*. The clean fluid delivered to pump 420*b* from clean fluid blender 410 may flush any residual slurry in pump 420*b* so that pump 420*b* may be shut down without damage or risk of slurry settling in the pump and later inhibiting the pump from being brought back online. In certain embodiments, valve control system 400 may be controlled by the same control unit 170 used to control the pumping units 105 and 115.

In certain embodiments, the valve control system 400 may be automated based on one or more measurements, for example measurements at one or more wellheads 150. As shown in FIGS. 1-3, in certain embodiments, one or more sensors 160 may be positioned between the one or more dirty pumps 120 and the one or more wellbores 150. For example, sensor 160*a* may be positioned between dirty pumps 120*a* and wellbore 150*a*, sensor 160*b* may be positioned between dirty pumps 120*b* and wellbore 150*b*, sensor 160*c* may be positioned between dirty pumps 120*c* and wellbore 150*c*, and sensor 160*d* may be positioned between dirty pumps 120*d* and wellbore 150*d*. In certain embodiments, the one or more sensors 160 may be positioned at or near one or more wellheads 151 of the wellbores 150, for example, wellheads 151*a*, 151*b*, 151*c*, and 151*d*. As shown in FIGS. 1-3, wellbore 150*a* may comprise a wellhead 151*a*, wellbore 150*b* may comprise a wellhead 151*b*, wellbore 150*c* may comprise a wellhead 151*c*, and wellbore 150*d* may comprise a wellhead 151*d*. Sensor 160 may be used to measure the amount of proppant concentration of the dirty fluid pumped from the dirty pumps 120 into the one or more wellbores 150. Sensor 160 may measure the proppant concentration of a dirty fluid and send a signal the controller 175 and/or 275. For example, sensor 160*a* may measure a proppant concentration of the dirty fluid entering the wellhead 151*a* and send a signal to sub-controller 276*a*. In certain embodiments, if the controller 175 and/or 275 determines that the proppant concentration for a given wellbore 150 drops to zero or near-zero, control unit 175 and/or 275 may send a signal to automatically open a valve 430, for example, valve 430*a* or 430*b*, such that clean fluid from clean fluid blender 410 flows to the one or more pumps 420 associated with the given wellbore 150 and flushes any residual proppant out of the one or more pumps 420. In certain embodiments, a predetermined proppant concentration threshold may be set such that if the proppant concentration for a given wellbore 150 drops below the threshold, a no-flow rate signal may be tripped and the control unit 175 and/or 275 may send a signal to open a valve 430 to flush the proppant from the one or more pumps 420.

Figure 5:
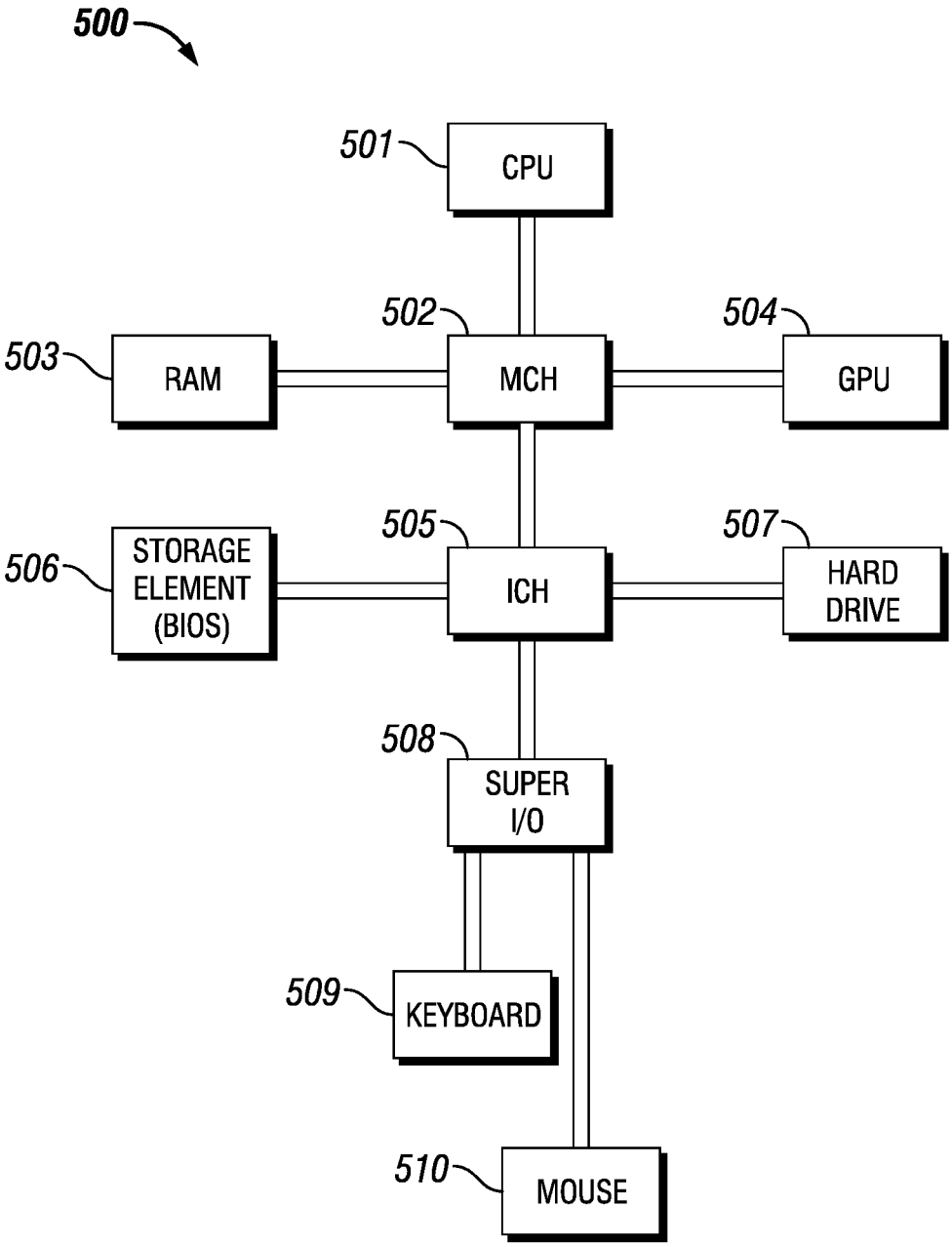
FIG. 5 is a block diagram illustrating an example information handling system, in accordance with certain embodiments of the present disclosure.

FIG. 5 is a diagram illustrating an example information handling system, according to aspects of the present disclosure. In certain embodiments, control units 175 and 275 may take a form similar to the information handling system 500. A processor or central processing unit (CPU) 501 of the information handling system 500 is communicatively coupled to a memory controller hub (MCH) or north bridge 502. The processor 501 may include, for example a microprocessor, microcontroller, digital signal processor (DSP), application specific integrated circuit (ASIC), or any other digital or analog circuitry configured to interpret and/or execute program instructions and/or process data. Processor 501 may be configured to interpret and/or execute program instructions or other data retrieved and stored in any memory such as memory 503 or hard drive 507. Program instructions or other data may constitute portions of a software or application for carrying out one or more methods described herein. Memory 503 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software program or application may be retrieved and stored in memory 503 for execution by processor 501.

Modifications, additions, or omissions may be made to FIG. 5 without departing from the scope of the present disclosure. For example, FIG. 5 shows a particular configuration of components of information handling system 500. However, any suitable configurations of components may be used. For example, components of information handling system 500 may be implemented either as physical or logical components. Furthermore, in one or more embodiments, functionality associated with components of information handling system 500 may be implemented in special purpose circuits or components. In one or more embodiments, functionality associated with components of information handling system 500 may be implemented in configurable general purpose circuit or components. For example, components of information handling system 500 may be implemented by configured computer program instructions.

Memory controller hub 502 may include a memory controller for directing information to or from various system memory components within the information handling system 500, such as memory 503, storage element 506, and hard drive 507. The memory controller hub 502 may be coupled to memory 503 and a graphics processing unit 504. Memory controller hub 502 may also be coupled to an I/O controller hub (ICH) or south bridge 505. I/O controller hub 505 is coupled to storage elements of the information handling system 500, including a storage element 506, which may comprise a flash ROM that includes a basic input/output system (BIOS) of the computer system. I/O controller hub 505 is also coupled to the hard drive 507 of the information handling system 500. I/O controller hub 505 may also be coupled to a Super I/O chip 508, which is itself coupled to several of the I/O ports of the computer system, including keyboard 509 and mouse 510.

Therefore, the present disclosure is well adapted to attain the ends and advantages mentioned as well as those that are inherent therein. Hydraulic fracturing induces stress in the formation. When multiple wells are fractured on the same pad or near one another, induced stresses in each wellbore can interact with one another. For example, with independent control of the rate of fluid being injected into each wellbore, an operator can control how hydraulic stresses in the formation build and the shape of the resulting stresses. In addition to interaction between fractures of multiple wellbores, there can also be interaction between different stages of fracturing a single wellbore. Using independent control of each wellbore, a control algorithm can be used to adjust the injection pressure, proppant concentration, and the total volume injected in order to optimize a fracture. In certain instances, an operator can optimize the length of the fracture both into the formation and out of the formation. Such optimization can be beneficial with cleanup potential of the fracture, for example, limiting drawdown pressure to aid in cleanup or water removal from the formation.

A system and method for independent control of simultaneous fracturing for multiple wellbores is disclosed. In certain embodiments, a system comprises a first transfer unit providing a first fluid and a second transfer unit providing a second fluid. In certain embodiments, a first and second pumping unit may be fluidically coupled to the first transfer unit, wherein the first pumping unit pumps the first fluid to a first wellbore and the second pumping unit pumps the first fluid to a second wellbore. In certain embodiments, a third and fourth pumping unit may be fluidically coupled to the second transfer unit, wherein the third pumping unit pumps the second fluid to the first wellbore and the fourth pumping unit pumps the second fluid to the second wellbore. In certain embodiments, a controller may be communicatively coupled to the first, second, third, and fourth pumping units, wherein the controller adjusts the pumping rate of at least one of the first, second, third, or fourth pumping units, based at least in part on, a desired parameter of at least one of the first or second wellbore.

In certain embodiments, the first transfer unit may be a boost pump and the first fluid may substantially comprise water. In certain embodiments, the second transfer unit may be a blender and the second fluid may comprise proppant. In certain embodiments, each of the first, second, third, and fourth pumping units may comprise one or more pumps. In certain embodiments, the desired parameter is a desired proppant concentration of a combined fluid pumping into the at least one of the first or second wellbore.

In certain embodiments, the controller may comprise one or more sub-controllers, wherein a first sub-controller controls the pumping rate of the first pumping unit and a second sub-controller controls a pumping rate of the second pumping unit. In certain embodiments, the first controller may further control the pumping rate of the third pumping unit and the second sub-controller may further control the pumping rate of the fourth pumping unit. In certain embodiments, a sensor may be communicatively coupled to a wellhead of at least one of the first and second wellbores, wherein the sensor measures a parameter of the second fluid. In certain embodiments, an additive storage unit may be fluidically coupled to the first transfer unit and a proppant storage unit fluidically coupled to the second transfer unit. In certain embodiments, the proppant storage unit may comprise a conveyor for transporting proppant to the second transfer unit.

In certain embodiments, a method comprises providing a slurry to a first pump, pumping the slurry from the first pump to a wellbore, providing a slurry to a second pump, pumping the slurry from a second pump to the wellbore, measuring a proppant concentration at the wellbore, in response to the proppant concentration measurement, providing a fluid to the first pump; and pumping the fluid from the first pump to the wellbore.

In certain embodiments, a first blending unit may provide the slurry to the first and second pumps. In certain embodiments, a second blending unit provides the fluid to the first pump. In certain embodiments, the method further comprises providing the fluid to the second pump and pumping the fluid from the second pump to the wellbore. In certain embodiments, a sensor may be coupled to a wellhead of the wellbore to measure the proppant concentration at the wellbore.

In certain embodiments, a system comprises a first clean pumping unit and a first dirty pumping unit fluidically coupled to a first wellbore, wherein the first clean pumping unit pumps a first fluid to the first wellbore and the second clean pumping unit pumps a second fluid to the first wellbore. In certain embodiments, the system further comprises a second clean pumping unit and a second dirty pumping unit fluidically coupled to a second wellbore, wherein the second clean pumping unit pumps the first fluid to the second wellbore and the second dirty pumping unit pumps. In certain embodiments, the system further comprises a controller for controlling a pumping rate of at least one of the first clean pumping unit and the first dirty pumping unit based, at least in part on, a desired parameter of a combined fluid pumped to the first wellbore.

In certain embodiments, the desired parameter is a desired proppant concentration of the combined fluid. In certain embodiments, the controller may control the pumping rate of the second clean pumping unit and the second dirty pumping based, at least in part on, a desired parameter of a combined fluid pumped to the second wellbore. In certain embodiments, the system may further comprise a third clean pumping unit and a third dirty pumping unit fluidically coupled to a third wellbore, wherein the third clean pumping unit pumps the first fluid to the third wellbore and the third dirty pumping unit pumps the second fluid to the third wellbore. In certain embodiments, the system may further comprise a fourth clean pumping unit and a fourth dirty pumping unit fluidically coupled to a fourth wellbore, wherein the fourth clean pumping unit pumps the first fluid to the fourth wellbore and the fourth dirty pumping unit pumps the second fluid to the fourth wellbore. In certain embodiments, a first transfer unit may be fluidically coupled to and supply the first fluid to the first clean pumping unit and second clean pumping unit; and a second transfer unit may be fluidically coupled to and supply the second fluid to the first dirty pumping unit and the second dirty pumping unit.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

What is claimed is:

1. A system comprising:

a first transfer unit providing a first fluid;

a second transfer unit providing a second fluid;

a first and second pumping unit fluidically coupled to the first transfer unit, wherein the first pumping unit pumps the first fluid to a first wellbore and the second pumping unit pumps the first fluid to a second wellbore;

a third and fourth pumping unit fluidically coupled to the first transfer unit and the second transfer unit, wherein the third pumping unit pumps the first fluid or the second fluid to the first wellbore and the fourth pumping unit pumps the first fluid or the second fluid to the second wellbore;

a first clean valve fluidically coupled between the first transfer unit and the third pumping unit;

a second clean valve fluidically coupled between the first transfer unit and the fourth pumping unit;

a first dirty valve fluidically coupled between the second transfer unit and the third pumping unit;

a second dirty valve fluidically coupled between the second transfer unit and the fourth pumping unit;

wherein the third pumping unit pumps the first fluid to the first wellbore in response to the first clean valve being set to the open position and the first dirty valve being set to the closed position;

wherein the fourth pumping unit pumps the first fluid to the second wellbore in response to the second clean valve being set to the open position and the second dirty valve being set to the closed position; and a controller communicatively coupled to the first, second, third, and fourth pumping units, wherein the controller adjusts the pumping rate of at least one of the first, second, third, or fourth pumping units, based at least in part on, a desired parameter of at least one of the first or second wellbore.

2. The system of claim 1, wherein the first transfer unit is a boost pump and the first fluid substantially comprises water.

3. The system of claim 1, wherein the second transfer unit is a blender and the second fluid comprises proppant.

4. The system of claim 1, wherein each of the first, second, third, and fourth pumping units comprise one or more pumps.

5. The system of claim 1, wherein the desired parameter is a desired proppant concentration of a combined fluid pumping into the at least one of the first or second wellbore.

6. The system of claim 1, wherein the controller comprises one or more sub-controllers, and wherein a first sub-controller controls the pumping rate of the first pumping unit and a second sub-controller controls a pumping rate of the second pumping unit.

7. The system of claim 6, wherein the first controller controls the pumping rate of the third pumping unit and the second sub-controller controls the pumping rate of the fourth pumping unit.

8. The system of claim 1, further comprising:

a sensor communicatively coupled to a wellhead of at least one of the first and second wellbores, wherein the sensor measures a parameter of the second fluid.

9. The system of claim 1, further comprising:

an additive storage unit fluidically coupled to the first transfer unit; and a proppant storage unit fluidically coupled to the second transfer unit.

10. The system of claim 9, wherein the proppant storage unit comprises a conveyor for transporting proppant to the second transfer unit.

11. A method, comprising:

providing a slurry to a first pump;

pumping the slurry from the first pump to a wellbore;

providing a slurry to a second pump;

pumping the slurry from a second pump to the wellbore;

measuring a proppant concentration at the wellbore, wherein the measurement of the proppant concentration is taken from a combined slurry concentration from the first pump and the second pump;

in response to the proppant concentration measurement, replacing the slurry delivered to the first pump with a fluid; and pumping the fluid from the first pump to the wellbore.

12. The method of claim 11, wherein a first blending unit provides the slurry to the first and second pumps.

13. The method of claim 11, wherein a second blending unit provides the fluid to the first pump.

14. The method of claim 11, further comprising:

providing the fluid to the second pump; and pumping the fluid from the second pump to the wellbore.

15. The method of claim 11, wherein a sensor coupled to a wellhead of the wellbore measures the proppant concentration at the wellbore.

16. A system, comprising:

a clean blender and a slurry blender fluidically coupled to a first dirty pumping unit and a second dirty pumping unit;

a first clean pumping unit and the first dirty pumping unit fluidically coupled to a first wellbore, wherein the first clean pumping unit pumps a first fluid to the first wellbore and the first dirty pumping unit pumps a first dirty fluid to the first wellbore;

a second clean pumping unit and the second dirty pumping unit fluidically coupled to a second wellbore, wherein the second clean pumping unit pumps the first fluid to the second wellbore and the second dirty pumping unit pumps a second dirty fluid to the second wellbore;

wherein the first dirty fluid transitions to a clean fluid in response to the slurry blender being decoupled from the first pumping unit or the first dirty fluid is a dirty fluid in response to the clean blender being decoupled from the first pumping unit; and a controller for controlling a pumping rate of the first clean pumping unit and the first dirty pumping unit based, at least in part on, a desired parameter of a combined fluid pumped to the first wellbore.

17. The system of claim 16, wherein the desired parameter is a desired proppant concentration of the combined fluid.

18. The system of claim 16, where the controller controls the pumping rate of the second clean pumping unit and the second dirty pumping based, at least in part on, a desired parameter of a combined fluid pumped to the second wellbore.

19. The system of claim 16, further comprising:

a clean blender and a slurry blender fluidically coupled to a third dirty pumping unit and a fourth dirty pumping unit;

a third clean pumping unit and the third dirty pumping unit fluidically coupled to a third wellbore, wherein the third clean pumping unit pumps the first fluid to the third wellbore and the third dirty pumping unit pumps a third dirty fluid to the third wellbore; and a fourth clean pumping unit and the fourth dirty pumping unit fluidically coupled to a fourth wellbore, wherein the fourth clean pumping unit pumps the first fluid to the fourth wellbore and the fourth dirty pumping unit pumps a fourth dirty fluid to the fourth wellbore.

20. The system of claim 16, further comprising:

a first transfer unit fluidically coupled to and supplying the first fluid to the first clean pumping unit and second clean pumping unit; and a second transfer unit fluidically coupled to and supplying the second fluid to the first dirty pumping unit and the second dirty pumping unit.

* * * * *